US008000617B2

(12) United States Patent
Kim et al.

(10) Patent No.: US 8,000,617 B2
(45) Date of Patent: Aug. 16, 2011

(54) IMAGE FORMING APPARATUS HAVING TONER CONTAINERS OF VARYING SIZES

(75) Inventors: Young-min Kim, Suwon-si (KR); Su-in Lee, Seongnam-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 190 days.

(21) Appl. No.: 12/402,567

(22) Filed: Mar. 12, 2009

(65) Prior Publication Data

US 2010/0061742 A1 Mar. 11, 2010

(51) Int. Cl.
*G03G 15/08* (2006.01)

(52) U.S. Cl. ..... 399/27; 399/35; 399/223; 399/297; 399/298; 399/299; 399/300; 399/301; 399/360

(58) Field of Classification Search ..... 399/27, 399/35, 223, 297–301, 360
See application file for complete search history.

(56) References Cited

U.S. PATENT DOCUMENTS

| | | | | |
|---|---|---|---|---|
| 2003/0185601 | A1* | 10/2003 | Toyohara et al. | 399/302 |
| 2005/0158080 | A1* | 7/2005 | Wakahara | 399/227 |
| 2007/0134016 | A1* | 6/2007 | Watanabe et al. | 399/101 |
| 2007/0196148 | A1* | 8/2007 | Shishikura | 399/360 |
| 2007/0248387 | A1* | 10/2007 | Iwamoto | 399/302 |
| 2008/0063421 | A1 | 3/2008 | Tamaki | |

FOREIGN PATENT DOCUMENTS

| | | | |
|---|---|---|---|
| JP | 2002156823 A | * | 5/2002 |
| JP | 2004021134 | | 1/2004 |
| JP | 2005315953 | | 11/2005 |
| JP | 2008065123 | | 3/2008 |

OTHER PUBLICATIONS

English Abstract JP2002156823A to Inoue.*

* cited by examiner

*Primary Examiner* — Ryan D Walsh
(74) *Attorney, Agent, or Firm* — Stanzione & Kim, LLP

(57) ABSTRACT

An image forming apparatus including cyan (C), magenta (M), yellow (Y), and black (K) developing units using a C developer, a M developer, a Y developer, and a K developer, respectively; at least one auxiliary developing unit using a developer other than the C, M, Y, and K developers; a plurality of photosensitive media formed in the C, M, Y, and K developing units and the auxiliary developing unit, respectively; a plurality of cleaning members formed in the C, M, Y, and K developing units and the auxiliary developing unit, respectively, so as to clean surfaces of the plurality of photosensitive media; and waste developer storage units formed in the C, M, Y, and K developing units and the auxiliary developing unit, respectively, so as to collect waste developer cleaned by the plurality of cleaning members. The developer storage unit and waste developer storage unit of at least one of the C, M, Y, and K developing units, in which there is a large amount of developer consumed and a large amount of waste developer generated, are larger than the developer storage unit and waste developer storage unit of the auxiliary developing unit.

34 Claims, 9 Drawing Sheets

IMAGE FORMING APPARATUS HAVING TONER CONTAINERS OF VARYING SIZES

CROSS-REFERENCE TO RELATED APPLICATIONS

This application claims priority under 35 U.S.C. §119(a) from Korean Patent Application No. 10-2008-0088826, filed on Sep. 9, 2008, in the Korean Intellectual Property Office, the disclosure of which is incorporated herein by reference in its entirety.

BACKGROUND

1. Field of the Invention

The present general inventive concept relates to an image forming apparatus to form images using yellow, magenta, cyan, and black (respectively referred to hereinbelow as "Y," "M," "C," and "K") developers, and light color developers, a white developer, or a transparent developer.

2. Description of the Related Art

As digital technology develops, high-quality electrophotographic image forming apparatuses, such as printers, copiers, and multifunctional peripherals are required. In particular, demand for high resolution, fine and faithful color reproduction, extension of the color reproduction range, high clarity, and faithful gradation are increasing.

In electrophotographic image forming apparatuses that form color images using four basic color developers (Y, M, C, and K), it is difficult to uniformly attach developer particles to dots having a regular electric potential without the developer particles spreading, and the image gradation corresponding to the dot density ratio of developer areas to non-developer areas is poor, thereby causing limitations in the resolution, color reproduction, clarity, and gradation.

General electrophotographic image forming apparatuses are suitable for printing text, but are inappropriate for printing pictures requiring high resolution, faithful color reproduction, high clarity, and faithful gradation.

On the other hand, image forming apparatuses such as inkjet printers use approximately 11 or 12 color liquid developers, and thereby can obtain images having high resolution, faithful color reproduction, high clarity, and faithful gradation.

SUMMARY OF THE INVENTION

The present general inventive concept provides an image forming apparatus to form images using four basic color developers, namely yellow, magenta, cyan, and black (Y, M, C, and K) developers, and light color developers, and/or a white developer, or a transparent developer, so images having high resolution, faithful color reproduction, high clarity, and faithful gradation can be obtained.

In addition, in an image forming apparatus using five or more color developers, a developer storage unit and/or waste developer storage unit of a more frequently used color developer are made larger than other developer storage units and/or waste developer storage units, so use of space in the image forming apparatus become more efficient and life of components can be extended.

Additional aspects and utilities of the present general inventive concept will be set forth in part in the description which follows and, in part, will be obvious from the description, or may be learned by practice of the general inventive concept.

Embodiments of the present general inventive concept may be achieved by providing an image forming apparatus to form an image according to a four-color developing method using yellow, magenta, cyan, and black (Y, M, C, and K) developing units or a multi-color developing method using Y, M, C, and K developing units and at least one auxiliary developing unit, the image forming apparatus including a first developing part including the Y, M, C, and K developing units, each developing unit including a developer storage unit to store Y, M, C, and K developers, respectively, a second developing part including the at least one auxiliary developing unit including a developer storage unit to store a developer other than the Y, M, C, and K developers, and a plurality of photosensitive media, one photosensitive medium formed in each of the Y, M, C, and K developing units and the auxiliary developing unit, wherein the developer storage unit of at least one of the Y, M, C, and K developing units is larger than the developer storage unit of the auxiliary developing unit.

The developer storage unit of the K developing unit may be larger than the developer storage units of other developing units.

The developer storage units of the Y, M, C, and K developing units may be larger than the developer storage unit of the auxiliary developing unit. The developer storage unit of the K developing unit may be larger than the developer storage units of the Y, M, and C developing units.

Each of the photosensitive media may be formed in a drum shape or in a belt shape.

Each developer storage unit may be integrally formed with the respective developing unit, or be detachably formed with the respective developing unit.

Each developer storage unit may include a sensing unit to sense the level of developer therein. The sensing unit may include a light emitting sensor and a light receiving sensor which are disposed to face each other on a lower part of the developer storage unit.

The developer in the auxiliary developing unit may be a light cyan developer or a light magenta developer, or a white developer, or a transparent developer.

The auxiliary developing unit may include a first auxiliary developing unit to use a light magenta developer, and a second auxiliary developing unit to use a light cyan developer.

The auxiliary developing unit may include a first auxiliary developing unit to use a white developer, and a second auxiliary developing unit to use a transparent developer.

The auxiliary developing unit may include a first auxiliary developing unit to use a light magenta developer, a second auxiliary developing unit to use a light cyan developer, a third auxiliary developing unit to use a white developer, and a fourth auxiliary developing unit to use a transparent developer.

The image forming apparatus may further include an intermediate transfer unit to receive overlapping developer images from the plurality of photosensitive media, a plurality of cleaning members, one cleaning member formed in each of the Y, M, C, and K developing units and the auxiliary developing unit, so as to clean non-transferred waste developer remaining on the plurality of photosensitive media, and a plurality of waste developer storage units, one waste developer storage unit formed in each of the Y, M, C, and K developing units and the auxiliary developing unit, so as to collect the waste developer cleaned by the plurality of cleaning members, wherein the waste developer storage unit of at least one of the Y, M, C, and K developing units is larger than the waste developer storage unit of the auxiliary developing unit.

The waste developer storage unit of the K developing unit may be larger than the waste developer storage units of other developing units.

The waste developer storage units of the Y, M, C, and K developing units may be larger than the waste developer storage unit of the auxiliary developing unit, and the waste developer storage unit of the K developing unit may be larger than the waste developer storage units of the Y, M, and C developing units.

Each waste developer storage unit may be integrally formed with the respective developing unit, or may be detachably formed with the respective developing unit.

Each waste developer storage unit may include a sensing unit to sense the level of waste developer therein, and the sensing unit may include a light emitting sensor and a light receiving sensor which are disposed to face each other on an upper part of the waste developer storage unit.

The auxiliary developing unit, the Y developing unit, the M developing unit, the C developing unit, and the K developing unit may be sequentially disposed in the direction of rotation of the intermediate transfer unit.

Embodiments of the present general inventive concept may also be achieved by providing an image forming apparatus including a black (K) developing unit to store a K developer, a cyan (C) developing unit, a magenta (M) developing unit, and a yellow (Y) developing unit to store a C developer, a M developer, and a Y developer, respectively, at least one auxiliary developing unit to store a developer other than the C, M, Y, and K developers, a plurality of photosensitive media, one photosensitive medium formed in each of the C, M, Y, and K developing units and the auxiliary developing unit, a plurality of cleaning members, one cleaning member formed in each of the C, M, Y, and K developing units and the auxiliary developing unit, so as to clean surfaces of the plurality of photosensitive media, and a plurality of waste developer storage units, one waste developer storage unit formed in each of the C, M, Y, and K developing units and the auxiliary developing unit, so as to collect waste developer cleaned by the plurality of cleaning members, wherein the waste developer storage unit of at least one of the C, M, Y, and K developing units is larger than the waste developer storage unit of the auxiliary developing unit.

The waste developer storage unit of the K developing unit may be larger than the waste developer storage unit of at least one of the other developing units.

The waste developer storage units of the C, M, Y, and K developing units may be larger than the waste developer storage unit of the auxiliary developing unit, and the waste developer storage unit of the K developing unit may be larger than the waste developer storage units of the C, M, and Y developing units.

An image forming apparatus according to an exemplary embodiment of the present general inventive concept uses a light magenta and a light cyan developer, or a white developer or a transparent developer, so pictures having a high resolution, high clarity, and faithful color reproduction and gradation can be printed.

In addition, in an image forming apparatus according to an exemplary embodiment of the present general inventive concept, a developer storage unit and waste developer storage unit in a frequently used developing unit is made larger than other developer storage units and waste developer storage units in infrequently used developing units, so unnecessary space generated due to the sizes of the developer storage units and/or waste developer storage units can be reduced and resources can be utilized more efficiently. In addition, if the size of the developer storage units and waste developer storage units differ, incorrect insertion of the developer storage units and/or waste developer storage units can be prevented.

An image forming apparatus, comprising: a plurality of developing units to store developer, each developing unit including a developer storage unit; and a plurality of photosensitive mediums, each photosensitive medium formed in a respective one of the plurality of developing units, wherein the developer storage unit of at least one of the developing units is larger than the developer storage units of all of the other developing units.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
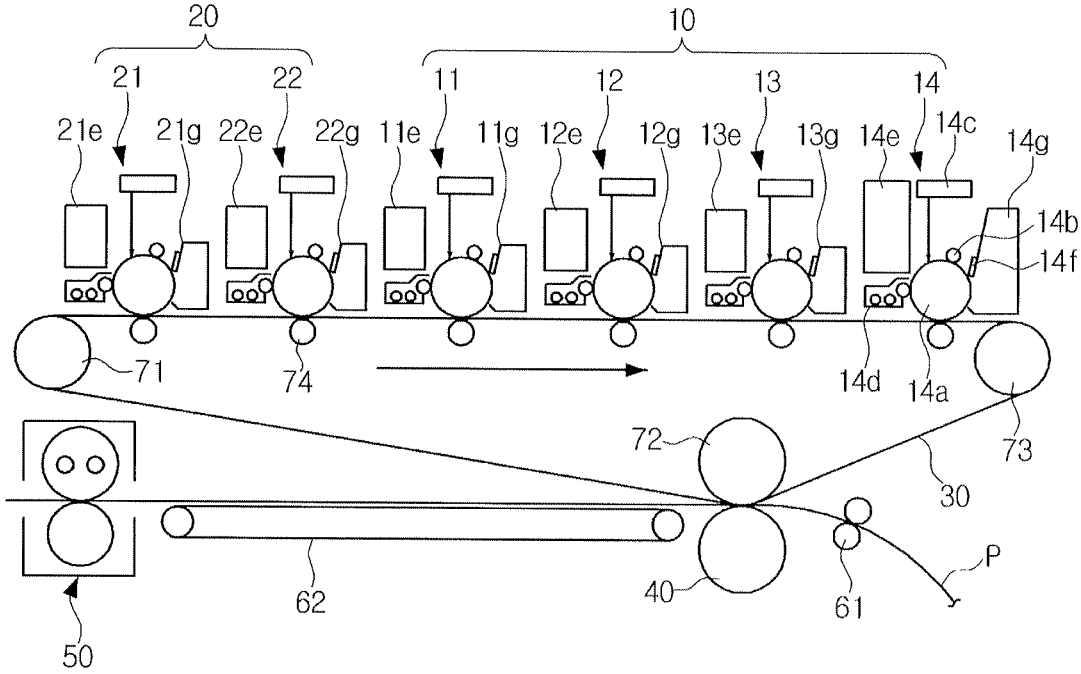
FIG. 1 is a schematic diagram illustrating a configuration of an image forming apparatus according to an exemplary embodiment of the present general inventive concept.

Reference will now be made in detail to the present embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a schematic diagram illustrating a configuration of an image forming apparatus according to an exemplary embodiment of the present general inventive concept. As illustrated in FIG. 1, the image forming apparatus may include a first developing unit 10, a second developing unit 20, an intermediate transfer unit 30, a secondary transfer unit 40, and a fusing unit 50. In FIG. 1, elements indicated by reference numbers 61 and 62 are components to transfer printing paper P, elements indicated by reference numbers 71, 72, and 73 are rollers to rotatably support the intermediate transfer unit 30, and elements indicated by reference number 74 are backup rollers.

The first developing unit 10 may include a Y developing unit 11, an M developing unit 12, a C developing unit 13, and a K developing unit 14 to develop images using yellow, magenta, cyan, and black developers, respectively. The second developing unit 20 may include a first auxiliary developing unit 21 and a second auxiliary developing unit 22 to develop images using light color developers.

The first auxiliary developing unit 21 develops images using a light magenta developer, and the second auxiliary developing unit 22 develops images using a light cyan developer. In FIG. 1, a 6 color image forming apparatus is illustrated, including the first and second auxiliary developing units 21 and 22, but the image forming apparatus according to the exemplary embodiment of the present general inventive concept may be a 5 color image forming apparatus including only one auxiliary developing unit using either a light magenta developer or a light cyan developer. Alternatively, the image forming apparatus according to this exemplary embodiment of the present general inventive concept may be a 7 color or 8 color image forming apparatus. The light color auxiliary developers may be used to enhance printouts having soft tones such as pictures, or to obtain images having high resolution, high clarity, and faithful color reproduction and gradation.

The first and second auxiliary developing units 21 and 22 may use a white developer and a transparent developer, respectively. The white developer may be used to make colors of the Y, M, C, and K developers softer, to print a specific pattern on areas other than an area printed using the Y, M, C, and K developers, or to make specific effects such as the feel of a material, luster on the surface of printing paper, or removal of contaminant on printing paper. The transparent developer may be used to protect Y, M, C, and K developer images by coating the surface of the Y, M, C, and K developer images, in addition to having similar uses to the white developer.

Figure 2:
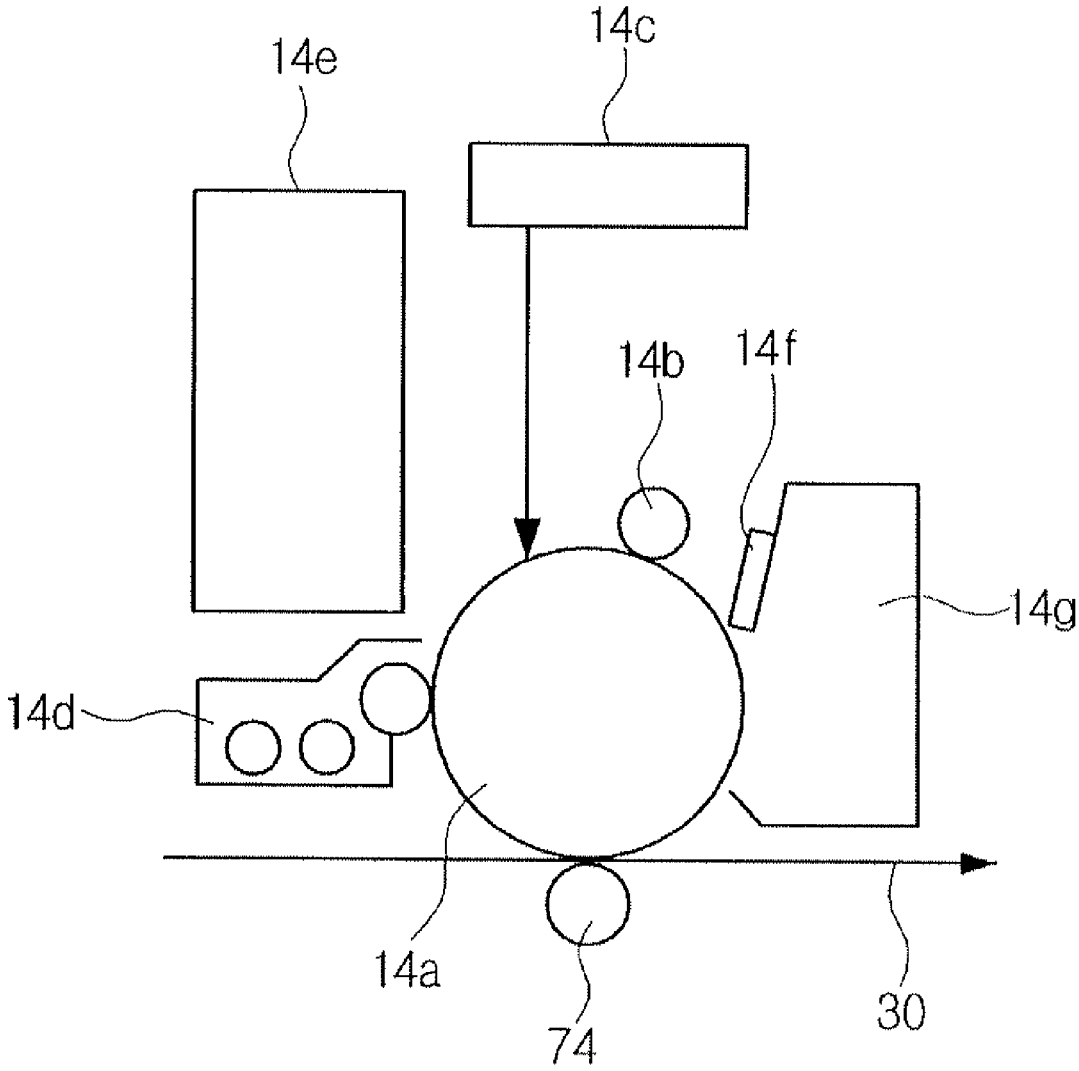
FIG. 2 is a schematic diagram illustrating a K developing unit used in the image forming apparatus of FIG. 1.

As illustrated in FIG. 1, the first auxiliary developing unit 21, the second auxiliary developing unit 22, the Y developing unit 11, the M developing unit 12, the C developing unit 13, and the K developing unit 14 are sequentially disposed in the direction in which the intermediate transfer unit 30 travels. Such developing units 11, 12, 13, 14, 21, and 22 have the same configuration. In FIG. 2, the K developing unit 14 is shown as a representative illustration of a developing unit. Hereinbelow, the K developing unit 14 is described with reference to FIG. 2, but the remaining developing units 11, 12, 13, 21, and 22 have the same configuration as the K developing unit 14, so detailed description of the remaining developing units 11, 12, 13, 21, and 22 is omitted here and corresponding components have the same reference numerals.

As illustrated in FIG. 2, the K developing unit 14 may include a photosensitive medium 14*a*, an electrification roller 14*b* to electrify the photosensitive medium 14*a*, an exposure unit 14*c* to form an electrostatic latent image on the electrified photosensitive medium 14*a*, a developing component 14*d* to develop the electrostatic latent image formed on the electrified photosensitive medium 14*a*, a developer storage unit 14*e* to supply developer to the developing component 14*d*, a cleaning member 14*f* to clean non-transferred developer remaining on the photosensitive medium 14*a*, and a waste developer storage unit 14*g* to store waste developer cleaned by the cleaning member 14*f*.

Figure 3:
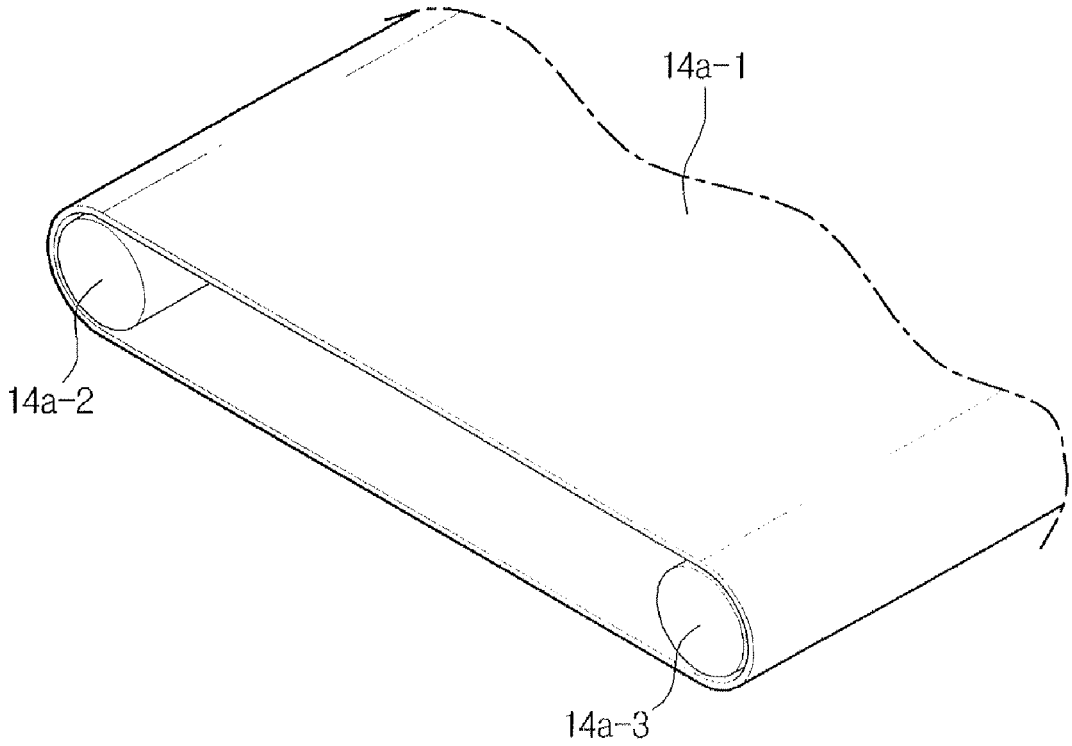
FIG. 3 is a schematic perspective view of a photosensitive medium according to another exemplary embodiment of the present general inventive concept.

In FIG. 2, the photosensitive medium 14*a* is formed in a drum shape, but is not limited thereto. As illustrated in FIG. 3, the photosensitive medium 14*a*-1 may also be formed in a belt shape. In FIG. 3, a photosensitive belt 14*a*-1 is rotatably supported by two or more rollers 14*a*-2 and 14*a*-3.

Figure 4:
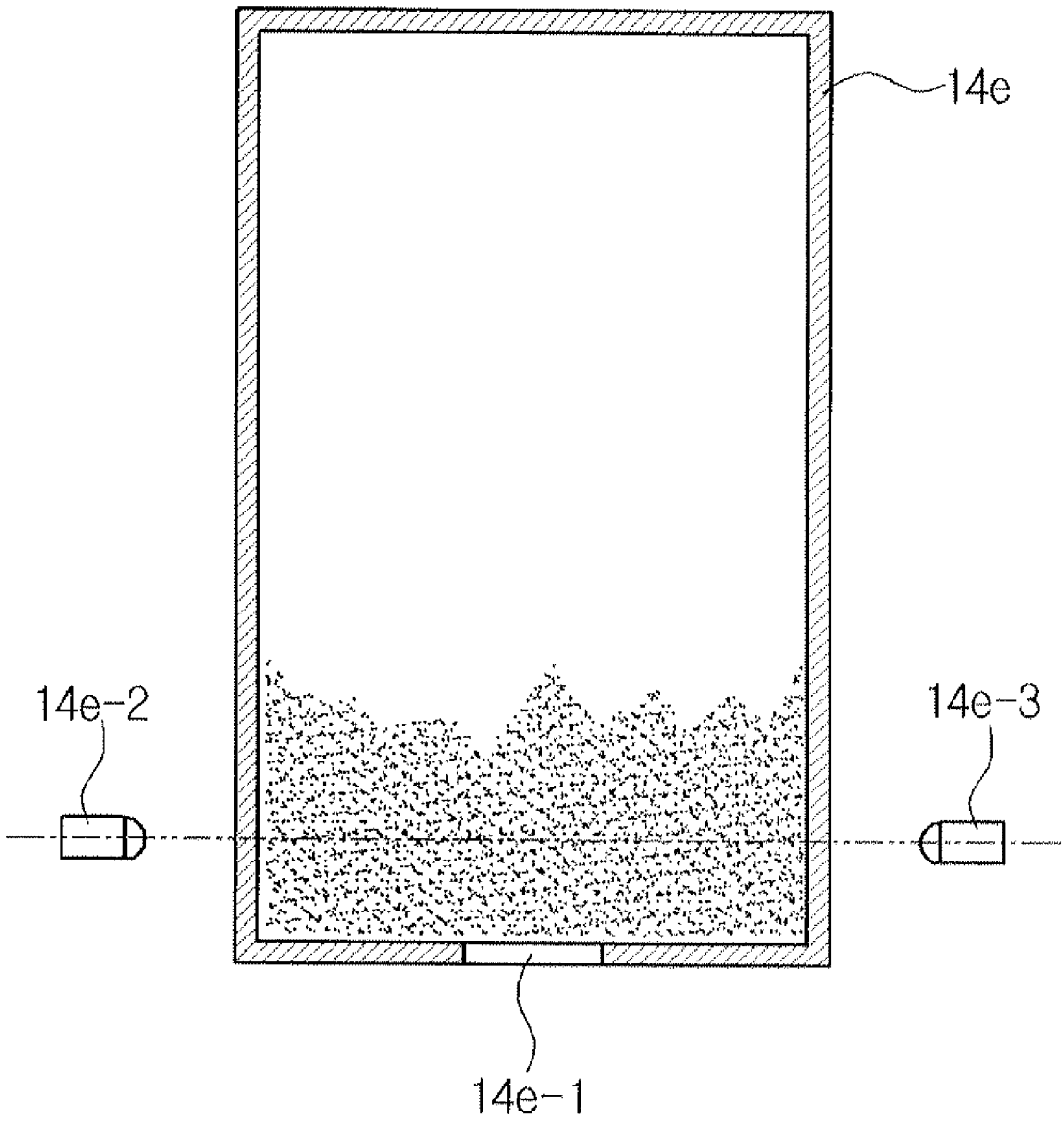
FIG. 4 is a detailed diagram of a developer storage unit used in the image forming apparatus according to an exemplary embodiment of the present general inventive concept.

As illustrated in FIG. 4, the developer storage unit 14*e* may include a developer discharge hole 14*e*-1 at the bottom thereof, and a sensing unit to sense the level of developer therein. The sensing unit may include a light emitting sensor 14*e*-2 and a light receiving sensor 14*e*-3 which are disposed to face each other at the lower part of the developer storage unit 14*e*. Light emitted from the light emitting sensor 14*e*-2 passes through the developer storage unit 14*e* and is received by the light receiving sensor 14*e*-3. If the level of developer contained in the developer storage unit 14*e* falls below a reference level, the amount of light received by the light receiving sensor 14*e*-3 increases above a predetermined level since there is no developer between the light emitting sensor 14*e*-2 and the light receiving sensor 14*e*-3. Accordingly, the light receiving sensor 14*e*-3 notifies the user that the developer is empty, so the user knows that the developer should be replaced. Such a sensing unit may be implemented as a photo sensor as described above, or may be implemented as a pressure sensor to measure the weight of the developer or the amount of vibrations, or as an electrostatic capacitance sensor to sense the electrostatic capacitance. The developer storage unit 14*e* may be integrally formed with the K developing unit 14 or may be formed so as to be detachable from the K developing unit 14.

Figure 5:
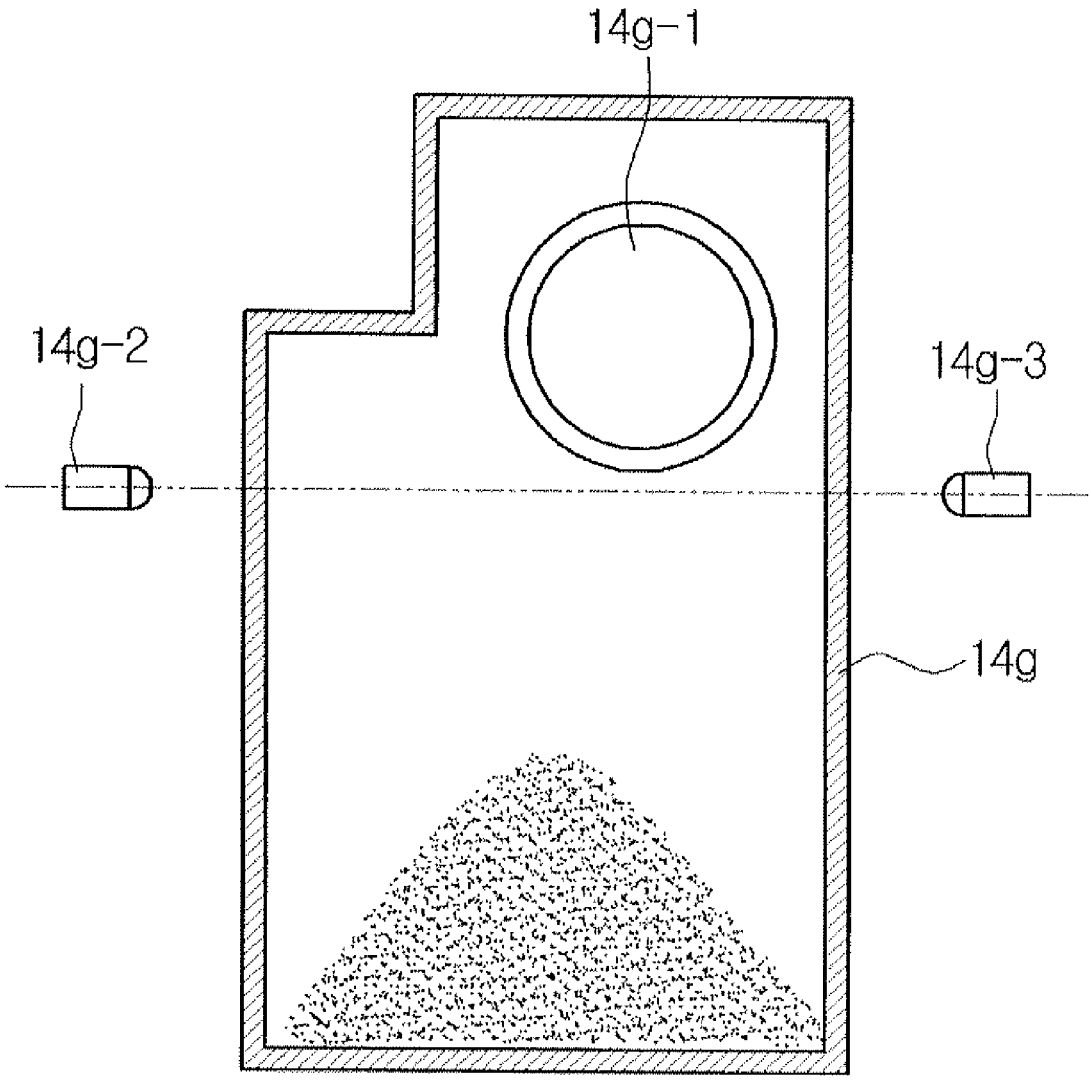
FIG. 5 is a detailed diagram of a waste developer storage unit used in the image forming apparatus according to an exemplary embodiment of the present general inventive concept.

As illustrated in FIG. 5, the waste developer storage unit 14*g* may include a waste developer inlet 14*g*-1 at the upper part thereof, and a sensing unit to sense the level of developer therein. If the waste developer collected in the waste developer storage unit 14*g* reaches a predetermined level, the sensing unit senses the level of waste developer and issues a warning notice to the user. If the waste developer overflows, the overflowing waste developer contaminates the image forming apparatus, so the collected waste developer should be managed so as not to overflow.

The sensing unit may be implemented as a photo sensor. That is, as illustrated in FIG. 5, the sensing unit may include a light emitting sensor 14*g*-2 and a light receiving sensor 14*g*-3 which are disposed to face each other on the external upper part of the waste developer storage unit 14*g*. Light emitted from the light emitting sensor 14*g*-2 passes through the waste developer storage unit 14*g* and is received by the light receiving sensor 14*g*-3. If waste developer is collected in the waste developer storage unit 14*g* between the light emitting sensor 14*g*-2 and the light receiving sensor 14*g*-3, and the amount of light received by the light receiving sensor 14*g*-3 is below a predetermined level, the light receiving sensor 14*g*-3 notifies the user that the waste developer storage unit 14*g* is full of waste developer, so the user can empty or replace the waste developer storage unit 14*g*. Such a sensing unit may be implemented as a photo sensor as described above, or may be implemented as a pressure sensor to measure the weight of the developer or the amount of vibrations, or as an electrostatic capacitance sensor to sense the electrostatic capacitance. The waste developer storage unit 14*g* may be integrally formed with the K developing unit 14 or may be formed so as to be detachable from the K developing unit 14.

The intermediate transfer unit 30 can be disposed so as to be in external contact with the photosensitive media 11*a*, 12*a*, 13*a*, 14*a*, 21*a*, and 22*a* formed in the developing units 11, 12, 13, 14, 21, and 22, respectively, and can be rotated. Developer images developed by the photosensitive media 11*a*, 12*a*, 13*a*, 14*a*, 21*a*, and 22*a* overlap and are transferred onto the intermediate transfer unit 30. Non-transferred developer remaining on the photosensitive medium 14*a* can be cleaned by the cleaning member 14*f*, and collected in the waste developer storage unit 14*g*.

The developer images transferred onto the intermediate transfer unit 30 can be subsequently transferred onto printing paper P which passes between the intermediate transfer unit 30 and the secondary transfer unit 40, and the printing paper P onto which the developer images have been transferred passes through the fusing unit 50 and is discharged. When the printing paper P passes through the fusing unit 50, the developer images are fused on the printing paper P by heat and pressure.

Referring back to FIG. 1, in an image forming apparatus according to an exemplary embodiment of the present general inventive concept, the developer storage unit 14*e* and the waste developer storage unit 14*g* in the K developing unit 14 are larger than the developer storage units 11*e*, 12*e*, 13*e*, 21*e*, and 22*e* and the waste developer storage unit 11*g*, 12*g*, 13*g*, 21*g*, and 22*g* in the developing units 11, 12, 13, 21, and 22. This is because the K developer is used more frequently than other developers. Detailed description is given below.

Since each developer expresses a different color tone, brightness, and chroma, at least a portion of the additives used for each developer, such as a base resin, an internal additive, and an external additive, may be different. For example, since the colorant used to display each color may be different, different types of charge control agents, such as silica, or different ratios may be used to adjust the amount of charge according to the amount of colorant and the type of colorant. Therefore, the amount of developer used to express a single dot varies according to the color, and thereby the amount of developer used for images varies according to the color.

Also, in a multi-color developing method using five or six color developers instead of four basic color developers, the amount of developer used varies according to the color. If a light magenta developer and a light cyan developer are added to the four basic color developers, the light color developers are used more in order to express soft colors.

If a white developer or a transparent developer is used in addition to the four basic color developers, the white developer may be used to make the four basic colors lighter, but is used primarily to print a specific pattern on areas other than an area printed using the four basic color developers, or to make specific effects such as the feel of a material, luster on the surface of printing paper, or removal of contaminant on printing paper. The transparent developer may be used to protect the four basic developer images by coating the surface of the four basic color developer images, in addition to having similar uses to the white developer. Accordingly, for general printing documents, the white developer or the transparent developer may be used much more than the four basic color developers. Hence, in such a multi-color developing method, the amount of auxiliary developers (the light color developers, the white developer, or the transparent developer) used may be greater than the amount of the four basic color developers used.

However, analysis of the printing pattern of users generally reveals that black is used more than other colors since, in general, documents including text are printed more frequently than pictures. Consequently, the amount of black developer used is generally larger than other developers.

In color printing, the four basic color developers are generally used. In specific cases, in which pictures requiring soft tones are printed, or luster on the surface of printing paper or removal of contaminants on printing paper is required, a multi-color developing method may be used, but the frequency of use of the multi-color developing method is lower than the frequency of use of a four basic color developing method.

That is, if only one page is developed using multi-color developers, the amount of auxiliary developers used may be larger than the amount of the four basic color developers used, but the amount of the four basic color developers used is much larger than the amount of auxiliary developers used in view of the entire printed document. Among the four basic color developers, the K developer is used the most.

Based on this fact, in an image forming apparatus according to an exemplary embodiment of the present general inventive concept, the developer storage unit 14*e* in the K developing unit 14 is made larger than the developer storage units 11*e*, 12*e*, 13*e*, 21*e*, and 22*e* in the respective developing units 11, 12, 13, 21, and 22 as illustrated in FIG. 1.

An increase in the amount of a specific developer consumed indicates the increase in the amount of the specific developer developed, thereby indicating an increase in the generation of waste developer. A developer developed on a surface of a photosensitive medium is transferred onto a printing medium by a transfer unit. In general, not all developed developer is transferred, but only approximately 80% of the developed developer is transferred. That is, the transfer efficiency may be approximately 80%, but this may vary according to the printing pattern, printing environment, or printing mode. For example, in an environment having a low temperature and low moisture, the charge amount of developer increases, so the transfer efficiency may be higher than 80%, and in an environment having a high temperature and high moisture, the charge amount of developer decreases due to the moisture and temperature, so the transfer efficiency also decreases. If it is assumed that the transfer efficiency is 80%, 80 g of every 100 g of developer may be transferred, and the remaining 20 g may be collected in a waste developer storage unit by a cleaning member.

Therefore, as illustrated in FIG. 1, in the image forming apparatus according to the exemplary embodiment of the present general inventive concept, the waste developer storage unit 14*g* in the K developing unit 14 may be made larger than the waste developer storage units 11*g*, 12*g*, 13*g*, 21*g*, and 22*g* in other developing units 11, 12, 13, 21, and 22.

Figure 6:
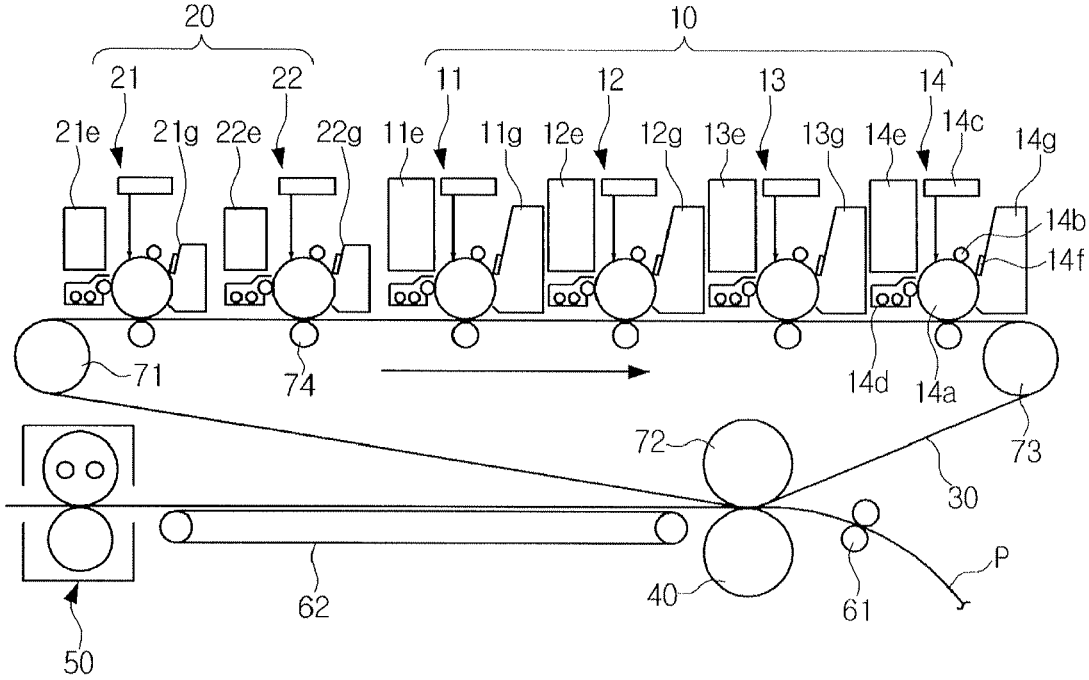
FIG. 6 is a schematic diagram illustrating a configuration of an image forming apparatus according to another exemplary embodiment of the present general inventive concept.

FIG. 6 illustrates an image forming apparatus according to another exemplary embodiment of the present general inventive concept. In this exemplary embodiment, according to the above principle that the amount of the four basic color developers Y, M, C, and K used is larger than the amount of auxiliary developers used, such as a light color developer, a white developer, or a transparent developer, developer storage units 11*e*, 12*e*, 13*e*, and 14*e* and/or waste developer storage units 11*g*, 12*g*, 13*g*, and 14*g* in the Y, M, C, and K developing units 11, 12, 13, and 14 are made larger than developer storage units 21*e* and 22*e* and/or waste developer storage units 21*g* and 22*g* in the first and second auxiliary developing units 21 and 22.

Figure 7:
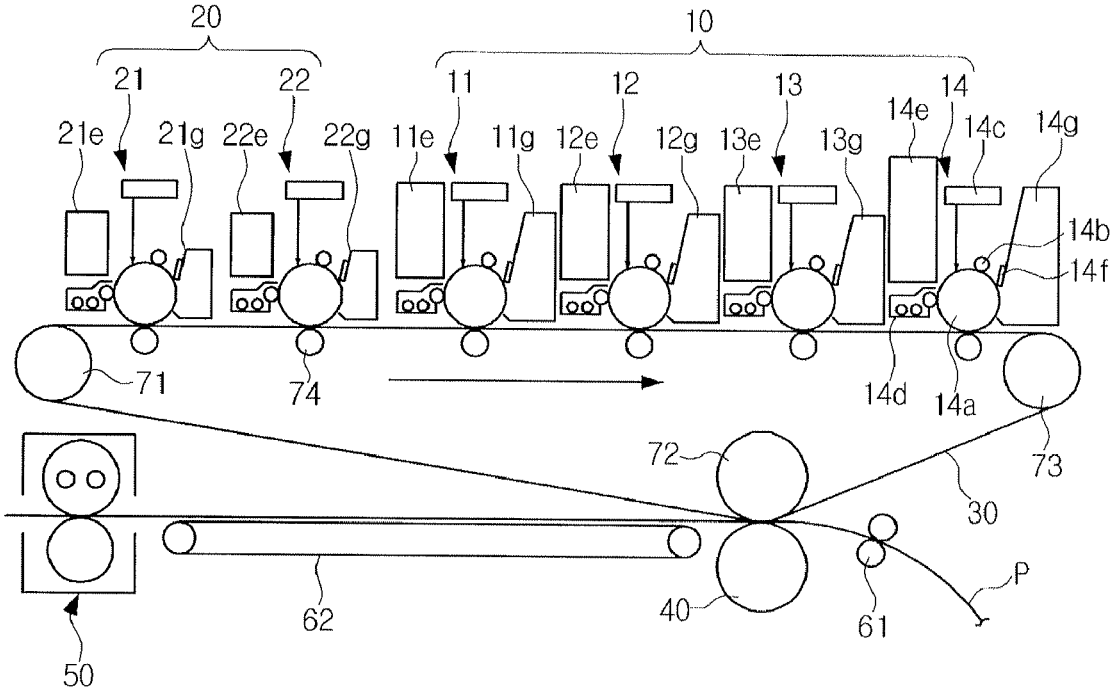
FIG. 7 is a schematic diagram illustrating a configuration of an image forming apparatus according to yet another exemplary embodiment of the present general inventive concept.

FIG. 7 is a schematic diagram illustrating an image forming apparatus according to yet another exemplary embodiment of the present general inventive concept. In this exemplary embodiment, which is a modified exemplary embodiment of FIG. 6, the developer storage units 11*e*, 12*e*, 13*e*, and 14*e* and/or the waste developer storage units 11*g*, 12*g*, 13*g*, and 14*g* in the Y, M, C, and K developing units 11, 12, 13, and 14 are made larger than the developer storage units 21*e* and 22*e* and/or the waste developer storage units 21*g* and 22*g* in the auxiliary developing units 21 and 22. Among them, the developer storage unit 14*e* and/or the waste developer storage unit 14*g* in the K developing units 14 are made the largest. That is, the sizes of the developer storage units and waste developer storage units differ according to the amount of developer consumed and the amount of waste developer. As described above, the amount of K developer consumed and amount of wasted K developer are the largest, followed by those of Y, M, and C developers, and those of auxiliary developers are the smallest.

As in the exemplary embodiment of FIG. 7, if the sizes of the developer storage units and waste developer storage units differ according to the amount of developer consumed, waste of unnecessary space generated due to the sizes of the developer storage units and waste developer storage units can be reduced and resources can be utilized more efficiently. In addition, if the size of the developer storage units and waste developer storage units differ according to the color of the respective developer, incorrect insertion of the developer storage units and waste developer storage units can be prevented. For example, if developing units are integrally formed with respective developer storage units and waste developer storage units, a K developing unit is prevented from being mounted in a space for other developing units since the size of the developer storage units and waste developer storage units differ. That is, the K developing unit cannot be mounted in a space for an auxiliary developing unit, so incorrect insertion can be prevented. Alternatively, if the developer storage unit and the waste developer storage unit can be separated from the developing unit and can be replaced, incorrect insertion can be prevented since the developer storage units and the waste developer storage units differ according to the color of the respective developer.

Figure 8:
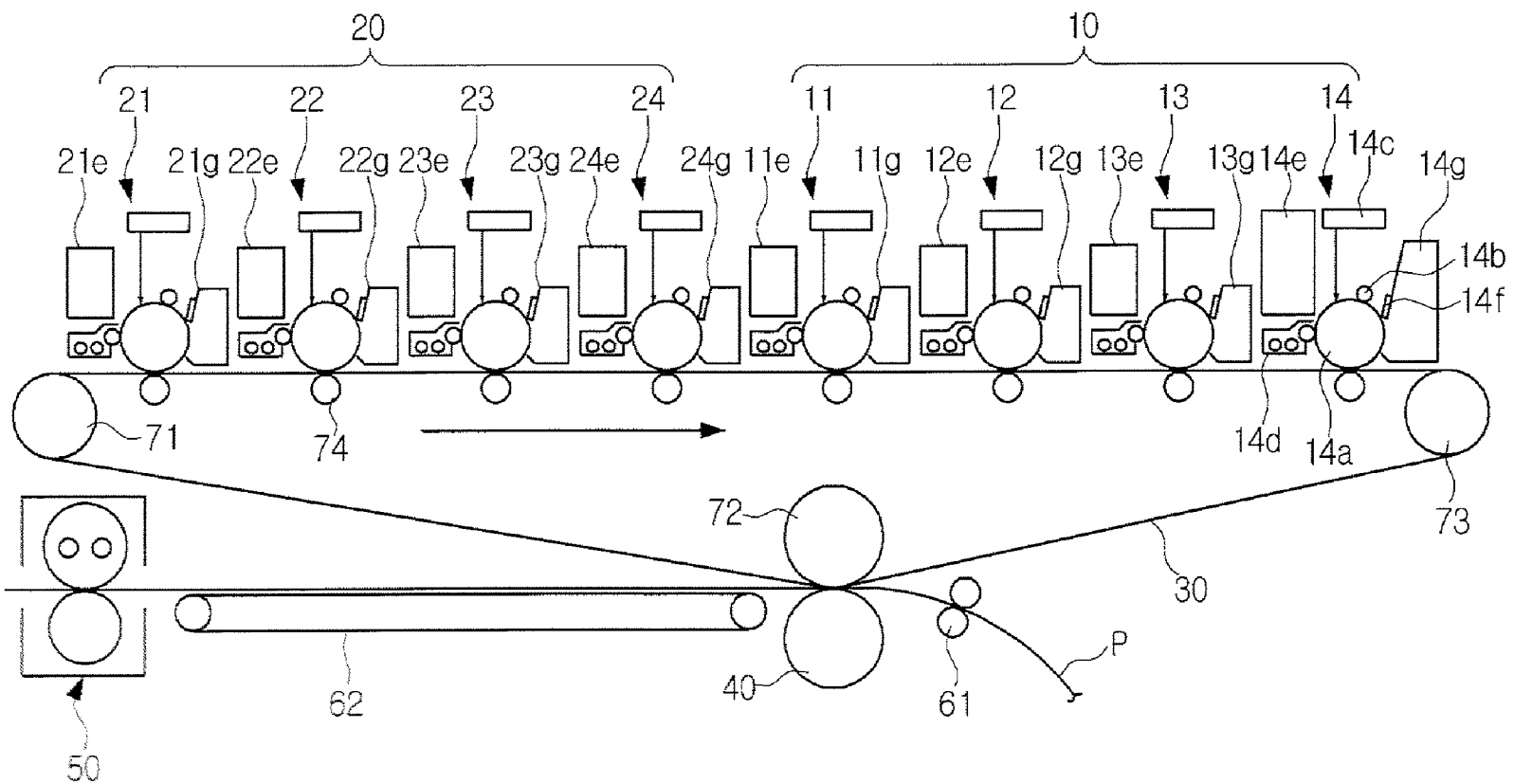
FIG. 8 is a schematic diagram illustrating a configuration of an image forming apparatus according to yet another exemplary embodiment of the present general inventive concept.

FIG. 8 illustrates an image forming apparatus according to yet another exemplary embodiment of the present general inventive concept. In this exemplary embodiment, a second developing unit 20 for auxiliary developers includes first to fourth auxiliary developing units 21, 22, 23, and 24. The first auxiliary developing unit 21 includes a light magenta developer, the second auxiliary developing unit 22 includes a light cyan developer, the third auxiliary developing unit 23 includes a white developer, and the fourth auxiliary developing unit 24 includes a transparent developer. In this case having the four auxiliary developing units 21 to 24, a K developer 14 from among four basic color C, M, Y, and K developing units 11 to 14 is consumed the most and generates the most waste developer. Accordingly, the developer storage unit 14*e* and/or the waste developer storage unit 14*g* in the K developing unit 14 is made larger than the developer storage units and/or waste developer storage units in other developing units 11, 12, 13, 21, 22, 23, and 24.

Figure 9:
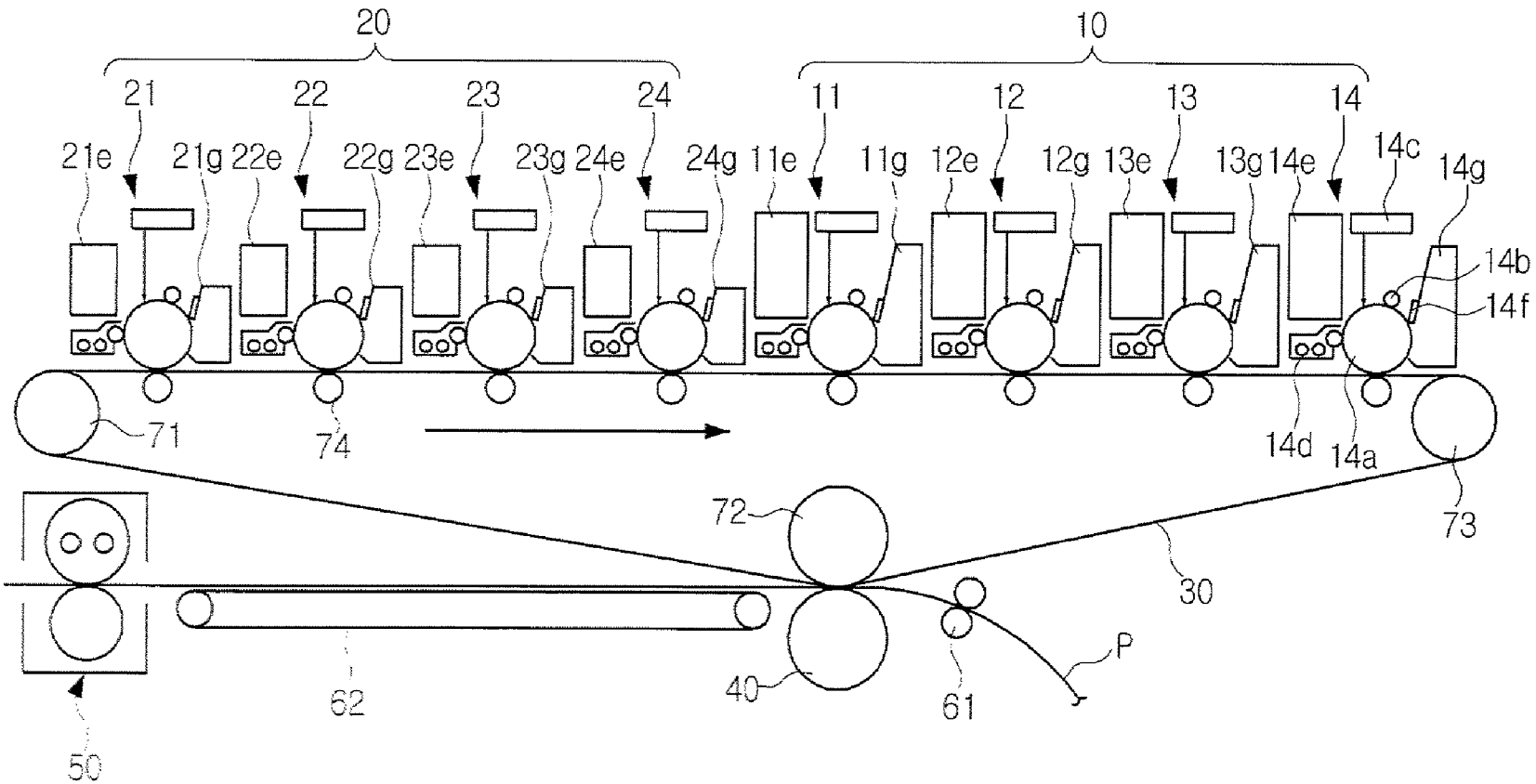
FIG. 9 is a schematic diagram illustrating a configuration of an image forming apparatus according to yet another exemplary embodiment of the present general inventive concept.

FIG. 9 illustrates an image forming apparatus according to yet another exemplary embodiment of the present general inventive concept. In this exemplary embodiment, which is a modified exemplary embodiment of FIG. 8, the amount of developer consumed from each of the four basic color Y, M, C, and K developing units 11, 12, 13, and 14 and the amount of waste developer generated thereby are larger than the amount of developer consumed from the auxiliary developing units 21, 22, 23, and 24, and the amount of waste developer generated thereby. Therefore, the developer storage units 11*e*, 12*e*, 13*e*, and 14*e* and the waste developer storage units 11*g*, 12*g*, 13*g*, and 14*g* in the Y, M, C, and K developing units 11, 12, 13, and 14 are made larger than the developer storage units 21*e*, 22*e*, 23*e*, and 24*e*, and the waste developer storage units 21*g*, 22*g*, 23*g*, and 24*g* in the auxiliary developing units 21, 22, 23, and 24.

Also, in a modified exemplary embodiment of FIG. 9, which is not illustrated, developer storage units 11*e*, 12*e*, 13*e*, and 14*e* and/or waste developer storage units 11*g*, 12*g*, 13*g*, and 14*g* in Y, M, C, and K developing units 11, 12, 13, and 14 are made larger than developer storage units 21*e*, 22*e*, 23*e*, and 24*e*, and waste developer storage units 21*g*, 22*g*, 23*g*, and 24*g* in auxiliary developing units 21, 22, 23, and 24. Among the Y, M, C, and K developing units 11, 12, 13, and 14, the developer storage unit 14*e* and/or the waste developer storage unit 14*g* in the K developing unit 14, which is used the most, is made larger than the developer storage units 11*e*, 12*e*, and 13*e* and/or the waste developer storage units 11*g*, 12*g*, and 13*g* in the Y, M, C developing units 11, 12, and 13.

Although various embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus to form an image according to a four-color developing method using yellow, magenta, cyan, and black (Y, M, C, and K) developing units or a multi-color developing method using Y, M, C, and K developing units and at least one auxiliary developing unit, the image forming apparatus comprising:

a first developing part including the Y, M, C, and K developing units, each developing unit including a developer storage unit to store Y, M, C, and K developers, respectively;

a second developing part including the at least one auxiliary developing unit including a developer storage unit to store a developer other than the Y, M, C, and K developers; and a plurality of photosensitive media, one photosensitive medium formed in each of the Y, M, C, and K developing units and the auxiliary developing unit, wherein the developer storage unit of at least one of the Y, M, C, and K developing units is larger than the developer storage unit of the auxiliary developing unit.

2. The image forming apparatus according to claim 1, wherein the developer storage unit of the K developing unit is larger than the developer storage units of other developing units.

3. The image forming apparatus according to claim 1, wherein the developer storage units of the Y, M, C, and K developing units are larger than the developer storage unit of the auxiliary developing unit.

4. The image forming apparatus according to claim 3, wherein the developer storage unit of the K developing unit is larger than the developer storage units of the Y, M, and C developing units.

5. The image forming apparatus according to claim 1, wherein each of the photosensitive media is formed in a drum shape.

6. The image forming apparatus according to claim 1, wherein at least one of the photosensitive media is formed in a belt shape.

7. The image forming apparatus according to claim 1, wherein each developer storage unit is integrally formed with the respective developing unit.

8. The image forming apparatus according to claim 1, wherein each developer storage unit is detachably formed with the respective developing unit.

9. The image forming apparatus according to claim 1, wherein each developer storage unit comprises a sensing unit to sense the level of developer therein.

10. The image forming apparatus according to claim 9, wherein the sensing unit comprises a light emitting sensor and a light receiving sensor which are disposed to face each other on a lower part of the developer storage unit.

11. The image forming apparatus according to claim 1, wherein the developer in the auxiliary developing unit is a light cyan developer or a light magenta developer.

12. The image forming apparatus according to claim 1, wherein the developer in the auxiliary developing unit is a white developer or a transparent developer.

13. The image forming apparatus according to claim 1, wherein the auxiliary developing unit comprises a first auxiliary developing unit to use a light magenta developer, and a second auxiliary developing unit to use a light cyan developer.

14. The image forming apparatus according to claim 1, wherein the auxiliary developing unit comprises a first auxiliary developing unit to use a white developer, and a second auxiliary developing unit to use a transparent developer.

15. The image forming apparatus according to claim 1, wherein the auxiliary developing unit comprises a first auxiliary developing unit to use a light magenta developer, a second auxiliary developing unit to use a light cyan developer, a third auxiliary developing unit to use a white developer, and a fourth auxiliary developing unit to use a transparent developer.

16. The image forming apparatus according to claim 1, further comprising:

an intermediate transfer unit to receive overlapping developer images from the plurality of photosensitive media;

a plurality of cleaning members, one cleaning member formed in each of the Y, M, C, and K developing units and the auxiliary developing unit, so as to clean non-transferred waste developer remaining on the plurality of photosensitive media;

a plurality of waste developer storage units, one waste developer storage unit formed in each of the Y, M, C, and K developing units and the auxiliary developing unit, so as to collect the waste developer cleaned by the plurality of cleaning members; and wherein the waste developer storage unit of at least one of the Y, M, C, and K developing units is larger than the waste developer storage unit of the auxiliary developing unit.

17. The image forming apparatus according to claim 16, wherein the waste developer storage unit of the K developing unit is larger than the waste developer storage units of other developing units.

18. The image forming apparatus according to claim 16, wherein the waste developer storage units of the Y, M, C, and K developing units are larger than the waste developer storage unit of the auxiliary developing unit.

19. The image forming apparatus according to claim 18, wherein the waste developer storage unit of the K developing unit is larger than the waste developer storage units of the Y, M, and C developing units.

20. The image forming apparatus according to claim 16, wherein each waste developer storage unit is integrally formed with the respective developing unit.

21. The image forming apparatus according to claim 16, wherein each waste developer storage unit is detachably formed with the respective developing unit.

22. The image forming apparatus according to claim 16, wherein each waste developer storage unit comprises a sensing unit to sense the level of waste developer therein.

23. The image forming apparatus according to claim 22, wherein the sensing unit comprises a light emitting sensor and a light receiving sensor which are disposed to face each other on an upper part of the waste developer storage unit.

24. The image forming apparatus according to claim 16, wherein the auxiliary developing unit, the Y developing unit, the M developing unit, the C developing unit, and the K developing unit are sequentially disposed in the direction of rotation of the intermediate transfer unit.

25. An image forming apparatus, comprising:

a black (K) developing unit to store a K developer;

a cyan (C) developing unit, a magenta (M) developing unit, and a yellow (Y) developing unit to store a C developer, a M developer, and a Y developer, respectively;

at least one auxiliary developing unit to store a developer other than the C, M, Y, and K developers;

a plurality of photosensitive media, one photosensitive medium formed in each of the C, M, Y, and K developing units and the auxiliary developing unit;

a plurality of cleaning members, one cleaning member formed in each of the C, M, Y, and K developing units and the auxiliary developing unit, so as to clean surfaces of the plurality of photosensitive media; and a plurality of waste developer storage units, one waste developer storage unit formed in each of the C, M, Y, and K developing units and the auxiliary developing unit, so as to collect waste developer cleaned by the plurality of cleaning members, wherein the waste developer storage unit of at least one of the C, M, Y, and K developing units is larger than the waste developer storage unit of the auxiliary developing unit.

26. The image forming apparatus according to claim 25, wherein the waste developer storage unit of the K developing unit is larger than the waste developer storage unit of at least one of the other developing units.

27. The image forming apparatus according to claim 25, wherein the waste developer storage units of the C, M, Y, and K developing units are larger than the waste developer storage unit of the auxiliary developing unit.

28. The image forming apparatus according to claim 27, wherein the waste developer storage unit of the K developing unit is larger than the waste developer storage units of the C, M, and Y developing units.

29. The image forming apparatus according to claim 25, wherein each waste developer storage unit is integrally formed with the respective developing unit.

30. The image forming apparatus according to claim 25, wherein each waste developer storage unit is detachably formed with the respective developing unit.

31. The image forming apparatus according to claim 25, wherein each waste developer storage unit comprises a sensing unit to sense the level of waste developer therein.

32. The image forming apparatus according to claim 31, wherein the sensing unit comprises a light emitting sensor and a light receiving sensor which are disposed to face each other on an upper part of the waste developer storage unit.

33. The image forming apparatus of claim 25, wherein each waste developer storage unit includes a waste developer inlet at any portion thereof.

34. An image forming apparatus, comprising:

a plurality of developing units to store developer, each developing unit including a developer storage unit, the developer storage units including a cyan, magenta, yellow, and black developer storage unit and at least one auxiliary developer storage unit having a developer other than cyan, magenta, yellow, and black; and a plurality of photosensitive mediums, each photosensitive medium formed in a respective one of the plurality of developing units, wherein the developer storage unit of at least one of the developing units is larger than the developer storage units of all of the other developing units, and the developer storage unit corresponding to at least one of cyan, magenta, yellow, and black has a capacity greater than the developer storage unit of the at least one auxiliary developer storage unit.

* * * * *